US007114547B2

(12) United States Patent
Sullivan et al.

(10) Patent No.: US 7,114,547 B2
(45) Date of Patent: Oct. 3, 2006

(54) CASTING RING

(76) Inventors: Michael R. Sullivan, 25302 Ericson Way, Laguna Hills, CA (US) 92653; Ashwin Mehta, 12953 Andy Dr., Cerritos, CA (US) 90703

( * ) Notice: Subject to any disclaimer, the term of this patent is extended or adjusted under 35 U.S.C. 154(b) by 22 days.

(21) Appl. No.: 11/078,964

(22) Filed: Mar. 11, 2005

(65) Prior Publication Data

US 2006/0151141 A1 Jul. 13, 2006

Related U.S. Application Data

(60) Provisional application No. 60/643,177, filed on Jan. 11, 2005.

(51) Int. Cl.
*B22C 21/00* (2006.01)

(52) U.S. Cl. ..... 164/376; 164/237; 164/238

(58) Field of Classification Search ..... 164/376, 164/237, 238, 520
See application file for complete search history.

(56) References Cited

U.S. PATENT DOCUMENTS

| | | | | |
|---|---|---|---|---|
| 1,037,962 | A | 9/1912 | Moll | |
| 1,068,698 | A | 7/1913 | Pieper | |
| 1,225,206 | A | 5/1917 | Atkinson | |
| 1,429,322 | A | 9/1922 | Brophy | |
| 1,458,835 | A | 6/1923 | Lynn | |
| 1,582,294 | A | 4/1926 | Montuori | |
| 1,639,416 | A | 8/1927 | Spiro | |
| 1,976,655 | A | 10/1934 | Carpenter | |
| 2,188,915 | A | 2/1940 | Mizzy et al. | |
| 2,274,186 | A | 2/1942 | Brace | |
| 3,404,723 | A | 10/1968 | Lewis et al. | |
| 3,587,722 | A | 6/1971 | Slansky | 164/376 |
| 3,610,317 | A | 10/1971 | Benfield | 164/238 |
| 3,716,418 | A | 2/1973 | Kochavi | |
| 3,768,544 | A | 10/1973 | Padeh | 164/376 |
| 4,284,121 | A * | 8/1981 | Horton | 164/520 |
| 4,423,762 | A | 1/1984 | Trinkl et al. | 164/37 |
| 4,508,155 | A | 4/1985 | Rousseau | 164/35 |
| 4,573,921 | A | 3/1986 | Berger | 433/167 |
| 4,777,996 | A | 10/1988 | Finelt | 164/237 |
| 4,962,909 | A | 10/1990 | Kohler | 249/54 |
| 5,044,419 | A | 9/1991 | Ware | 164/34 |
| 5,183,095 | A * | 2/1993 | Sullivan | 164/34 |
| 5,360,052 | A | 11/1994 | Tomic et al. | 164/412 |
| 5,406,999 | A * | 4/1995 | Berger et al. | 164/376 |

(Continued)

FOREIGN PATENT DOCUMENTS

| | | |
|---|---|---|
| DE | 3716949 | 12/1988 |

(Continued)

*Primary Examiner*—Kevin Kerns
*Assistant Examiner*—I.-H. Lin
(74) *Attorney, Agent, or Firm*—Snell & Wilmer L.L.P.

(57) ABSTRACT

An apparatus comprising a casting ring and base sized and dimensioned to be coupled together to form a cavity having one or more walls comprising an inner surface of the casting ring, having a bottom comprising an upper surface of the base, and having a form receiving member portion of the base extending into the cavity. This embodiment includes an indicator forming portion sized and positioned to form an indicator on a mold produced by at least partially filling the cavity with investment and allowing the investment to harden. In some instances the casting ring may have a lower segment sized and dimensioned to surround and receive an upper segment of the base to couple the ring and base together, wherein, the casting ring latches onto an outwardly protruding shoulder of the base when the base and casting ring are coupled together.

20 Claims, 3 Drawing Sheets

U.S. PATENT DOCUMENTS

| | | | | |
|---|---|---|---|---|
| 5,469,908 | A | 11/1995 | Chmel et al. | 164/376 |
| 5,609,483 | A * | 3/1997 | Thomsen | 433/202.1 |
| 5,655,592 | A * | 8/1997 | Sullivan | 164/456 |
| 5,688,533 | A | 11/1997 | Berger | 425/123 |
| 6,386,503 | B1 | 5/2002 | Schleicher | 249/54 |
| 6,467,530 | B1 | 10/2002 | Bell | 164/244 |
| 2003/0047299 | A1 | 3/2003 | Ma | 164/376 |
| 2004/0108610 | A1 | 6/2004 | Foser et al. | 264/16 |

FOREIGN PATENT DOCUMENTS

| | | |
|---|---|---|
| JP | 2034246 | 2/1990 |
| JP | 10-005927 | 1/1998 |

* cited by examiner

CASTING RING

CROSS-REFERENCES TO RELATED APPLICATIONS

This application claims the benefit of Provisional Application No. 60/643,177, filed Jan. 11, 2005.

FIELD OF THE INVENTION

The present invention relates generally to mold formation, and more particularly to apparatus used to form molds, particularly molds for forming dental prosthesis.

BACKGROUND OF THE INVENTION

In some instances, the formation of a mold used to cast or otherwise form dental prosthesis or other small castings is accomplished using an apparatus comprising a casting ring and a base. Examples of such apparatus as well as descriptions as to how they are used can be found in at least U.S. Pat. Nos. 1,639,411, 5,153,095, 5,406,999, 5,655,692, 5,688,533, and 6,386,503, each of which is herein incorporated by reference in its entirety.

In some instances: (a) a form is positioned on a form receiving portion (typically a sprue former) of the base that extends into a central cavity of the flask formed by the casting ring and base; (b) investment is poured into the central cavity and allowed to harden to form a mold; (c) the mold is removed from the flask; (d) the form is removed, typically by melting it, from the mold; and (d) the mold is used to cast or otherwise form a dental prosthesis.

Although the use of casting rings and bases to form molds is known, it is contemplated that previously known rings and bases are not satisfactory in all instances. As such, the present disclosure is directed to a combination of casting ring and base that has advantages over previously known casting rings and bases.

SUMMARY OF THE INVENTION

An embodiment of the present invention is an apparatus comprising a casting ring and base sized and dimensioned to be coupled together to form a cavity having one or more walls comprising an inner surface of the casting ring, having a bottom comprising an upper surface of the base, and having a form receiving member portion of the base extending into the cavity. This embodiment includes an indicator forming portion sized and positioned to form an indicator on a mold produced by at least partially filling the cavity with investment and allowing the investment to harden.

Another embodiment of the present invention is an apparatus including a casting ring and base sized and dimensioned to be coupled together to form a cavity having one or more walls comprising an inner surface of the casting ring, having a bottom comprising an upper surface of the base, and having a form receiving member portion of the base extending into the cavity, wherein the casting ring has a lower segment sized and dimensioned to surround and receive an upper segment of the base to couple the ring and base together, wherein, the casting ring latches onto an outwardly protruding shoulder of the base when the base and casting ring are coupled together.

BRIEF DESCRIPTION OF THE DRAWINGS

The exact nature of this invention, as well as the objects and advantages thereof, will become readily apparent from consideration of the following specification in conjunction with the accompanying drawings in which like reference numerals designate like parts throughout the figures thereof and wherein.

DETAILED DESCRIPTION OF THE PREFERRED EMBODIMENTS

Reference will now be made to the preferred embodiments of the invention, examples of which are illustrated in the accompanying drawings. While the invention will be described in conjunction with the preferred embodiments, it will be understood that these embodiments are not intended to limit the invention. On the contrary, the invention is intended to cover alternatives, modifications and equivalents, which may be included within the spirit and scope of the invention as defined by the appended claims. In the following detailed description, numerous specific details are set forth in order to provide a thorough understanding of the present invention. However, it will be understood by one of ordinary skill in the art that the present invention may be practiced without these specific details. In other instances, well known methods, procedures, components, and circuits have not been described in detail so as not to unnecessarily obscure the important aspects of the present invention.

Figure 2:
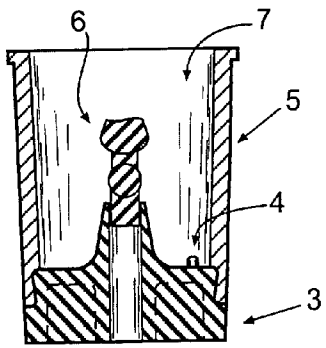
FIG. 2 is a cross sectional side view of the apparatus of FIG. 1.
Figure 1:
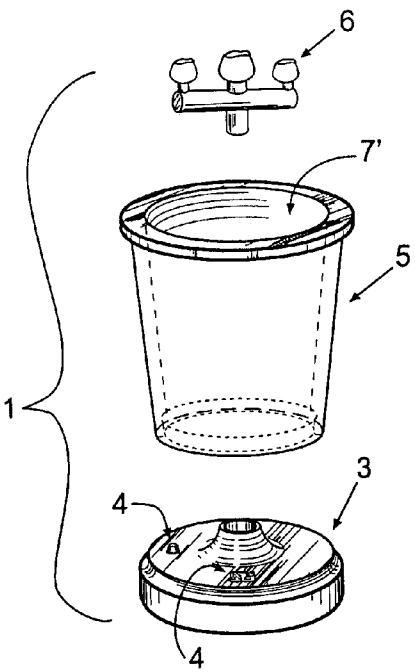
FIG. 1 is perspective view of a first apparatus in accordance with an exemplary embodiment of the invention.
Figure 15:
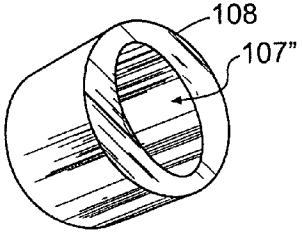
FIG. 15 is a perspective top view of an insert of the apparatus of FIG. 13.
Figure 16:
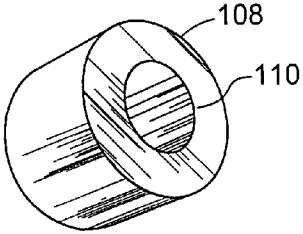
FIG. 16 is a perspective bottom of an insert of FIG. 15.
Figure 17:
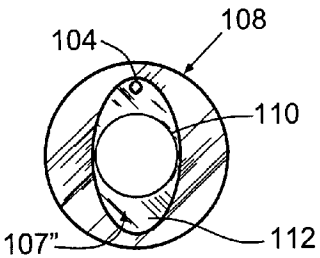
FIG. 17 is a top view of the insert of FIG. 15.
Figure 13:
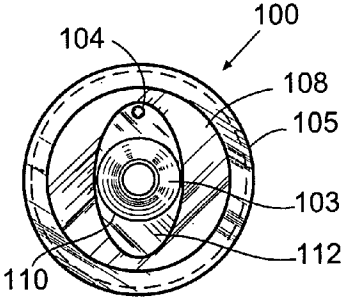
FIG. 13 is a top view of a second apparatus in accordance with an exemplary embodiment of the invention.
Figure 14:
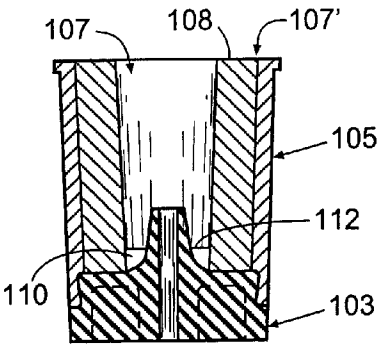
FIG. 14 is a cross sectional side view of the apparatus of FIG. 13.

In FIGS. 1 and 2, an apparatus 1 comprises a base 3, a casting ring 5, and a form 6. The casting ring 5 is hollow and substantially cylindrical with the hollow center of ring 5 being referred to as 7'. When the base 3 and the casting ring 5 are coupled together, the cavity 7 is formed with the base 3 plugging an end of the hollow portion 7' of the ring 5. In use, the base 3 is nested within the casting ring 5 while the casting ring 5 is disposed upon the base 3 to form the apparatus 1. The base 3 and the casting ring 5 are constructed from a transparent elastic thermoplastic.

The form 6 is inserted into the base 3, typically before the base 3 and casting ring 5 are coupled together. In some instances the base 3 and/or the casting ring 5 will include one or more indicator forming portions such as indicator forming portions 4 of FIG. 1. Such indicator forming portions provide a mechanism by which one or more indicators can be added to a mold produced by using the apparatus 1. Such a mold may be produced by at least partially filling the cavity 7 with investment and allowing the investment to harden. Such indicators can be used in a variety of ways such as to indicate a characteristic of the form 6. In some such instances, the characteristic may be an orientation of the form, in other such instances it might be an alloy type associated with the form, and in still other instances it may indicate the number of units that the form can produce.

The form indicator portions 4 of the apparatus 1 comprise a plurality of surface protrusions in the upper surface of the base which extend into the cavity 7. The surface protrusions will cause matching indentations to be formed in a mold produced using the apparatus 1. One of the indicator forming portions 4 forms the alphabetic characters NP while the other simply provides an indentation that corresponds to the orientation of the form 6. In alternative embodiments, indentations may be used instead of protrusions such that the indicator formed on the mold protrudes from the surface of the mold.

It is contemplated that the use of indicator forming portions 4 that form one or more alphanumeric characters in a mold produced using the apparatus can be beneficial in conveying information corresponding to a characteristic of the form and the resultant mold. As an example, alphanumeric characters can be used to indicate alloy type, with the characters "NP" indicating that a mold produced with such a form is suitable for use with non-precious metal, the characters "SP" indicating that the mold is suitable for use with semi-precious metals, "YG" indicating that the mold is suitable for use with yellow gold, "WG" with white gold, and "RG" with regular gold. As another example, numeric characters such as "1", "2", and "3" can be used to indicate the number of units that a mold can produce, i.e. that were part of the form 6. As such, an indicator adding a "3" to a mold would be appropriate to indicate the form 6 is suitable for forming three units.

Figure 5:
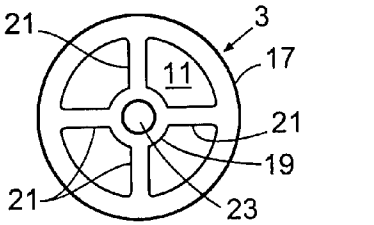
FIG. 5 is a bottom view of the base of FIG. 3.
Figure 3:
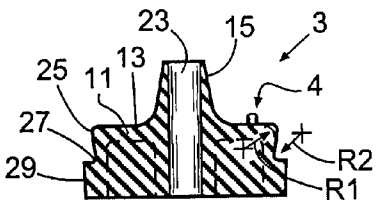
FIG. 3 is a cross sectional side view of a base of the apparatus of FIG. 1.
Figure 4:
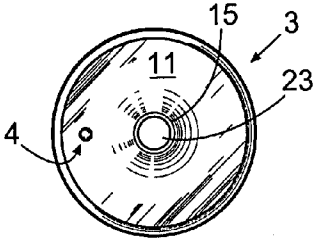
FIG. 4 is a top view of the base of FIG. 3.

Referring now primarily to FIGS. 3–5, the base 3 comprises a generally circular body portion 11 having an upper surface 13, and a conical form positioning member 15 extending upward from the center of the body portion 11. The member 15 has an inwardly and upwardly tapering exterior surface that is a continuation of the surface 13. Except for the portion that forms the exterior of member 15, the upper surface 13 of body portion 11 is generally flat and featureless. Conical member 15 contains a through hole 23 which may be dimensioned so that a sprue or shank of a form may be securely disposed within it. The through hole 23 extends through the base 3 and the conical form positioning member 15. The base 3 also comprises various members that extend from a side of the body portion 11 opposite surface 13 from which the member 15 extends. Such members include an annular flange 17, a central ring 19, and ribs 21 extending radially outward from ring 19 to flange 17. Additionally, the base 3 includes an outwardly protruding curved shoulder 25 and a curved indentation 27 encircling the upper portion of the base 3. The indentation 27 extends into the exterior surface of the flange 17 adjacent a lower segment 29 of the flange 17.

Figure 6:
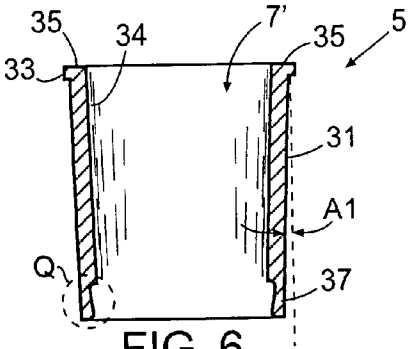
FIG. 6 is a cross sectional side view of a casting ring of the apparatus of FIG. 1.
Figure 7:
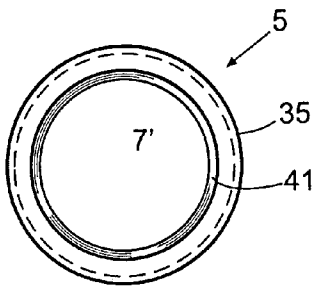
FIG. 7 is a top view of the casting ring of FIG. 6.
Figure 8:
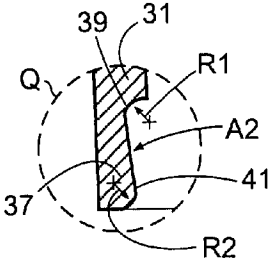
FIG. 8 is a detail view of a base coupling surface of the casting ring of FIG. 6.

Referring primarily to FIGS. 6–8, the casting ring 5 comprises an inwardly and downwardly tapering body portion 31 having an outwardly extending annular flange 33 integrally formed with an upper edge 35 of ring 5, and also has a flange member 37 extending axially from body portion 31. Flange 37 is adapted to receive and form a seal with the base 3. The inner surface of flange 37 comprises a curved indentation 39 and a curved protrusion 41 encircling hollow portion 7'.

The shape of casting ring 5 is such that the inside diameter of annular flange 35 is made slightly larger than the inside diameter of depending flange 37. The inward taper between flange 35 and flange 37, as defined by inside surface 34, is characterized by angle A1, and will range from approximately 1 degree to approximately 10 degrees. This taper allows for the stress free expansion of investment while it settles, and for the easy removal of a mold from the ring 5 after the investment is cured and the mold has set.

Figure 9:
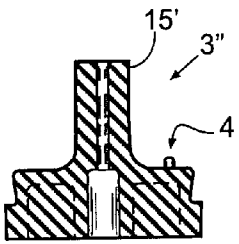
FIG. 9 is a cross sectional side view of a alternative base that can be substituted for the base of FIG. 3 in the apparatus of FIG. 1.

In FIG. 9, an alternative base 3" which can be used in place of base 3 of FIGS. 1 and 2 is shown. The base 3" differs from base 3 primarily in regard to the shape of receiving member 15', which is cylindrical rather than conical. The base 3" is particularly well adapted when pressing is to be used to force a material into a mold formed by using the apparatus 1. In such an instance, the size and shape of the receiving member is selected to form a cavity in a resultant mold that can receive an ingot of material to be forced into the mold. The cavity thus formed will have a volume corresponding to the volume of the form used to form the mold.

When ring 5 is placed upon base 3 (or base 3' of FIG. 9, or base 3" of FIG. 10), the flange 37 of the casting ring 5 engages the shoulder 25 and indentation 27 of the base 3 in investment-tight contact. The cavity 7 defined by plugging hollow portion 7' with base 3 is filled with a solution of a suitable investment. The investment may be any of the conventional compositions commonly used for lost wax casting or pressing.

It is important to note that the flange 37 of the ring 5 and the upper portion of the base 3 interlock in a unique manner with the indentation 39 of flange 37 receiving the shoulder 25 of the base 3, and the indentation 27 of the base 3 receiving the protrusion 41 of the sleeve 5. It should also be noted that once the flange 37 of the ring 5 initially slides over the shoulder 25, the base 3 is pulled firmly into the ring 5 even if no further force is applied to push the ring 5 and base 3 together.

The base 3 and the casting ring 5 are each constructed from a transparent elastic thermoplastic such as polyvinylchloride (PVC) polymethylmethacrylate (PMMA), polyalcrylonitrile, polypropylene and like material having a glass transition temperature of between about 25 degrees Celsius and about 105 degrees Celsius, and a melting point greater than the exothermic temperature of the chosen investment material. Each of the aforementioned plastics will typically contain a suitable plasticizer such as dibutyl phthalate, dioctylphthalate, nylon 610 or the like.

Although shown with form 6, the apparatus 1 may, in some embodiments, not include such a form. In such an instance, a customized form can be provided as a step in using the apparatus. Moreover, in some instances the apparatus 1 may include more or more components other than the base 3, ring 5, and form 6.

Figure 10:
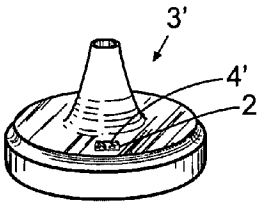
FIG. 10 is a perspective view of an alternative base for the apparatus of FIG. 1.
Figure 11:
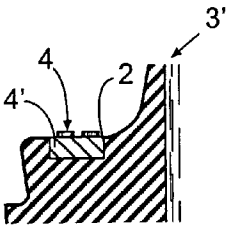
FIG. 11 is a cross sectional view of the base of FIG. 10.
Figure 12:
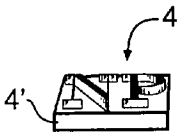
FIG. 12 is a perspective view of an insert shown in FIGS. 10 and 11.

One example of an additional component that might be included is a detachable member that is positioned within a cavity that is sized to receive the detachable member. In some instances, the detachable member may be an indicator forming member that extends from the cavity 7 into the inner surface of the casting ring 5 or the upper surface of the base 3. Referring to FIGS. 10–12, a base 3' includes a cavity 2 sized to receive member 4' which includes indicator forming portion 4. The use of a detachable indicator forming member allows forming portions 4 to be added to generic casting rings or bases.

Figure 19:
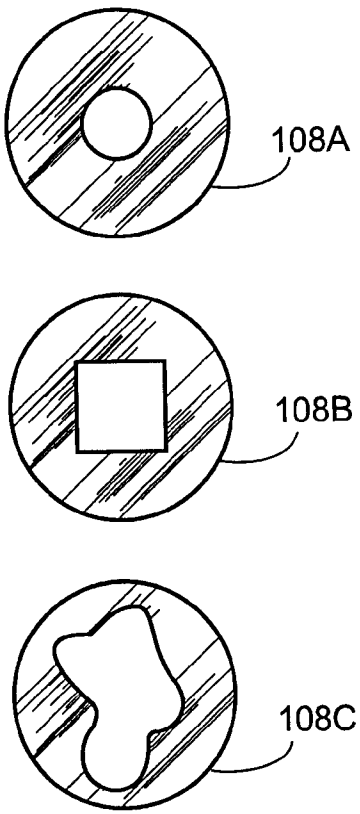
FIG. 19 provides a top view of three alternative inserts for the apparatus of FIG. 13.
Figure 18:
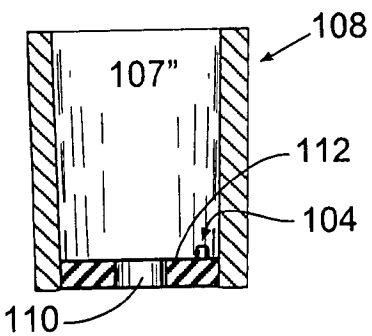
FIG. 18 is a cross sectional side view of the apparatus of FIG. 15.

Another example of an additional component that might be included as part of the apparatus 1 is a detachable or removable cavity shaping/volume reducing member that is positioned within the cavity 7 formed by the ring 5 and base 3 (or 3', or 3"). Such a volume reducing member can be used to reduce the amount of settlement required to produce a mold, and/or to change the shape of the mold to something other than the shape of the cavity 7' of the ring 5. Referring to FIGS. 13–16, an apparatus 100 includes a base 103, a ring 105, and a volume reducing/cavity shaping member 108. The volume reducing member 108 has an external shape that corresponds to the shape of the cavity 107' of the ring 105, and a hollow center 107" that cooperates with an upper surface of the base 103 to define the cavity 107 of the assembly 100 when the base 103, ring 105, and member 108 are coupled together. The volume of the hollow center 107" determines, to a large extent, the volume of settlement required to form a mold using the apparatus 100, and the resultant external shape of such a mold. Although shown as an ellipse, the hollow center 107" can have any cross sectional shape. As such, as shown in FIG. 19, a member 108A has a circular center, a member 108B has a polygonal center, and a member 108C has a center having an irregular curve shape.

In some instances the member 108 may have a bottom 112 with a through hole 110. By providing the member 108 with a bottom 112, the member 108 can modify another surface of a mold produced using the apparatus 100. In some instance, it can include a indicator forming portion 104 for forming an indicator on a mold as previously described herein.

Figure 20:
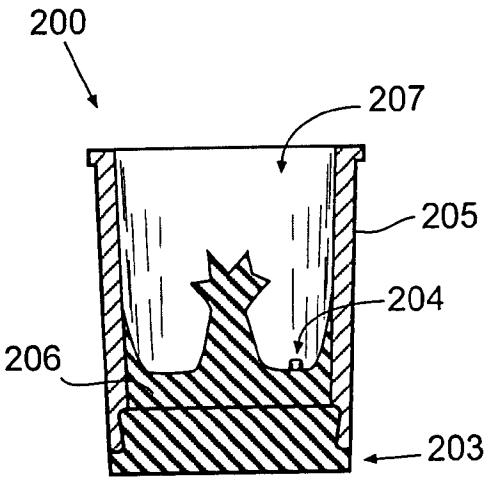
FIG. 20 is a cross sectional side view of a third apparatus in accordance with an exemplary embodiment of the invention.

It is contemplated that in some instances, some of the functionality provided by the base, indicator portions, and/or volume reducing members can be accomplished by modifying the form used to shape external as well as internal portions of a mold. As shown in FIG. 20, an apparatus 200 includes a base 203, a ring 205, and a form 206 having indicator forming portion 204. As with the apparatus 1 previously described, the apparatus 200 forms a cavity 207 in which investment can be placed and allowed to harden to form a mold. Unlike the apparatus 1, the apparatus 200 is not inserted into a sprue forming portion of the base 203, but instead rests on top of a flat surface of the base 203. As such, the form itself is used to form a sprue in the mold. Moreover, because it includes the indicator forming portion 204, the form itself can be used to add form specific indicators to a mold being produced using the apparatus 200.

The apparatus 1 is (as are apparatus 100 and 200) particularly suitable for preparing dental castings and like precisely dimensioned objects by the lost wax method. In such an instance, a positive form made out of paraffin or other similar material is shaped, as by carving, to conform to the desired casting. The form will typically have a shank or sprue depending therefrom. The form is then securely mounted into base 3 by inserting the shank or sprue into through hole 23. Ring 5 is then securely attached to base 3 in circumscription about form to define the apparatus of FIG. 2, with the form on the form receiving portion 15. A solution of investment is then prepared as needed and poured into the cavity. The investment is then allowed to set around the form thereby creating a mold which is the negative of the form.

Before the mold is suitably prepared for subsequent use, the investment must thoroughly hardened and cured. The process of hardening has two distinct phases. The first phase comprises that time during which the investment is exothermically transformed from a liquid which has no shape, into a solid which maintains the shape imparted to it by apparatus 1. This is called the setting process.

It is contemplated that, during the setting process, expansion of settlement material within the cavity 7 loosens the hold the casting ring 5 has on the base 3 making it easier to separate the base 3 from the ring 5. However, prior to such expansion, the matching shapes (which each may be substantially "S" shaped) cooperate to prevent accidental separation of the ring and base, even after the cavity 7 is filled with settlement material.

After the mold has set, it is removed from the apparatus 1 and allowed to cure for a suitable period. In some instances a suitable period may be approximately 30–45 minutes. The cured mold is then placed into an oven and heated to a temperature sufficient to liquefy the paraffin comprising the form. When the liquefied paraffin has flowed out of the mold through the opening defined in the cured investment corresponding to conical member 15, the mold becomes a true negative mold suitable for use in producing castings.

For molds including indicators, methods of using the mold will typically involve a step of identifying an indicator on the mold, and taking an action appropriate to the identified indicator. In some instances, the appropriate action may be simply to position or orient the mold in a particular way. In other instances, the appropriate action may be to select a material to be used in casting based on the identified indicator. In other instances, the appropriate action may be to determine how much material will be poured into the mold based on the identified indicator. As an example, using a mold to cast a dental prostheses may include selecting a mode, identifying an indicator formed on or in the mold, selecting a material associated with the identified indicator, and at least partially filling the mold with the selected material.

The use of an elastic material, which is more deformable than the paraffin of any form used, minimizes the distortions created by the expansion of investment during its exothermic setting. This dimensional accuracy is critical in the creation of dental castings and certain fine jewelry pieces. The stressed induced during setting are absorbed by the ring 5, and are not forced upon the softened paraffin of the form. Finally, the thermoplastics used herewith are not attacked by the investment solution whereas the metal rings used heretofore are rapidly corroded and gain only a minimal shelf life.

The embodiments of the present invention described herein comprise multiple novel features with each described embodiment including either a single such feature or a combination of such features. Other contemplated embodiments include all combinations of one or more such novel features not explicitly described herein as such combinations are readily discernable from the embodiments described. The following paragraphs provides examples of some such contemplated embodiments.

A contemplated embodiment of the present invention is an apparatus comprising a casting ring and base sized and dimensioned to be coupled together to form a cavity having one or more walls comprising an inner surface of the casting ring, having a bottom comprising an upper surface of the base, and having a form receiving member portion of the base extending into the cavity. In this embodiment the apparatus also comprises an indicator forming portion sized and positioned to form an indicator on a mold produced by at least partially filling the cavity with investment and allowing the investment to harden.

In some instances, the apparatus may also include and/or satisfy one or more of the following: (a) the indicator forming portion comprises a member of the apparatus that is detachable from the casting ring and base and is positioned at least partially within the cavity, and in some instances the detachable member is positioned within a cavity that is sized to receive the member and extends from the cavity into the inner surface of the casting ring or the upper surface of the base; (b) the indicator forming portion comprises at least one surface protrusion or indentation in the inner surface of the casting ring or the upper surface of the base, the at least one surface protrusion or indentation extending into or from the cavity; (e) the indicator forming portion comprises a plurality of surface protrusions or indentations forming one or more alphanumeric characters such that the indicator formed on a mold produced using the apparatus will comprise the same one or more alphanumeric characters; (f) the apparatus comprises a form coupled to the base, and the one or more alphanumeric characters indicate a characteristic of the form; (g) the characteristic is the orientation of the form relative to the indicator; (h) the characteristic is an alloy type associated with the form; and (i) the form comprises one or more units, and the characteristic is the number of units.

Another contemplated embodiment of the present invention is an apparatus comprising a casting ring and base sized and dimensioned to be coupled together to form a cavity having one or more walls comprising an inner surface of the casting ring, having a bottom comprising an upper surface of the base, and having a form receiving member portion of the base extending into the cavity, wherein the casting ring has a lower segment sized and dimensioned to surround and receive an upper segment of the base to couple the ring and base together, wherein: the casting ring latches onto an outwardly protruding shoulder of the base when the base and casting ring are coupled together.

In some instances, the apparatus may also include and/or satisfy one or more of the following: (a) the casting ring latches onto the outwardly protruding shoulder by receiving the protruding shoulder in an indentation sized and shaped similarly to the shoulder, the indentation extending horizontally into a wall of the inner surface of the casting ring; (b) latching the casting ring onto the should of the base inhibits movement of the base and casting ring in any direction relative to each other; (c) the lower segment of the casting ring includes a base coupling surface and the upper segment of the base includes a casting ring coupling surface; (d) the base coupling surface and casting ring coupling surface are substantially similar such that substantial portions of the coupling surfaces contact each other when the base and casting ring are coupled together; (e) a curved surface of the protruding shoulder of the base is part of the casting ring coupling surface; (f) the curved surface of the protruding shoulder of the base has a radius of curvature of between about 0.05 inches and about 0.07 inches; (g) the casting ring coupling surface and base coupling surface each comprise a curved indentation and a curved protrusion; (h) the curved indentation of the casting ring coupling surface receives the curved protrusion of the base coupling surface; (i) the curved indentation of the base coupling surface receives the curved protrusion of the casting ring coupling surface when the base and casting ring are coupled together; (j) the curved indentation and curved protrusion of each coupling surface are separated by a segment of the coupling surface that is sloped relative to a center axis of the casting ring; (k) the sloped segment of the coupling surface is sloped between about 6 degrees and about 9 degrees from the center axis; (1) the base and/or the casting ring is temporarily reshaped when coupling them together; and (m) expansion of settlement material within the cavity loosens the hold the casting ring has on the base.

What is claimed is:

1. An apparatus comprising:

a base having an outwardly protruding shoulder;

a casting ring having an inwardly tapered flange that mates with the outwardly protruding shoulder;

the casting ring and the base sized and dimensioned to be coupled together to form a cavity having one or more walls including an inner surface of the casting ring, having a bottom including an upper surface of the base, and having a form receiving member portion of the base extending into the cavity; and an indicator forming portion sized and positioned to form an indicator on a mold produced by at least partially filling the cavity with investment and allowing the investment to harden.

2. The apparatus of claim 1 wherein the indicator forming portion comprises a member of the apparatus that is detachable from the casting ring and base and is positioned at least partially within the cavity.

3. The apparatus of claim 2 wherein the detachable member is positioned within a cavity that is sized to receive the member and extends from the cavity into the inner surface of the casting ring or the upper surface of the base.

4. The apparatus of claim 1 wherein the indicator forming portion comprises at least one surface protrusion or indentation in the inner surface of the casting ring or the upper surface of the base, the at least one surface protrusion or indentation extending into or from the cavity.

5. The apparatus of claim 4 wherein the indicator forming portion comprises a plurality of surface protrusions or indentations forming one or more alphanumeric characters such that the indicator formed on a mold produced using the apparatus will comprise the same one or more alphanumeric characters.

6. The apparatus of claim 5 further comprising a form coupled to the base, wherein the one or more alphanumeric characters indicate a characteristic of the form.

7. The apparatus of claim 6 wherein the characteristic is the orientation of the form relative to the indicator.

8. The apparatus of claim 6 wherein the characteristic is an alloy type associated with the form.

9. The apparatus of claim 6 wherein the form comprises one or more units, and the characteristic is the number of units.

10. The apparatus of claim 1 wherein:

the casting ring has a lower segment sized and dimensioned to surround and receive an upper segment of the base to couple the ring and base together, and the casting ring latches onto an outwardly protruding shoulder of the base when the base and casting ring are coupled together.

11. The apparatus of claim 10 wherein the casting ring latches onto the outwardly protruding shoulder by receiving the protruding shoulder in an indentation sized and shaped similarly to the shoulder, the indentation extending horizontally into a wall of the inner surface of the casting ring.

12. The apparatus of claim 11 wherein latching the casting ring onto the shoulder of the base inhibits movement of the base and casting ring in any direction relative to each other.

13. The apparatus of claim 10 wherein:

the lower segment of the casting ring includes a base coupling surface and the upper segment of the base includes a casting ring coupling surface;

the base coupling surface and casting ring coupling surface are substantially similar such that substantial portions of the coupling surfaces contact each other when the base and casting ring are coupled together.

14. The apparatus of claim 13 wherein a curved surface of the protruding shoulder of the base is part of the casting ring coupling surface.

15. The apparatus of claim 14 wherein the curved surface of the protruding shoulder of the base has a radius of curvature of between about 0.05 inches and about 0.07 inches.

16. The apparatus of claim 13 wherein:

the casting ring coupling surface and base coupling surface each comprise a curved indentation and a curved protrusion;

the curved indentation of the casting ring coupling surface receives the curved protrusion of the base coupling surface; and the curved indentation of the base coupling surface receives the curved protrusion of the casting ring coupling surface when the base and casting ring are coupled together.

17. The apparatus of claim 16 wherein the curved indentation and curved protrusion of each coupling surface are separated by a segment of the coupling surface that is sloped relative to a center axis of the casting ring.

18. The apparatus of claim 17 wherein the sloped segment of the coupling surface is sloped between about 6 degrees and about 9 degrees from the center axis.

19. The apparatus of claim 10 wherein expansion of settlement material within the cavity loosens the hold the casting ring has on the base.

20. An apparatus comprising:

a base having an inwardly tapered portion;

a casting ring having an outwardly tapered portion that fits with the inwardly tapered portion;

the casting ring and the base sized and dimensioned to be coupled together to form a cavity having one or more walls including an inner surface of the casting ring, having a bottom including an upper surface of the base, and having a form receiving member portion of the base extending into the cavity; and an indicator forming portion sized and positioned to form an indicator on a mold produced by at least partially filling the cavity with investment and allowing the investment to harden.

* * * * *